United States Patent [19]

Murakami

[11] Patent Number: 4,571,199

[45] **Date of Patent: * Feb. 18, 1986**

[54] WRIST WATCH TYPE CONTAINER FOR TOY ROBOT OR THE LIKE

[75] Inventor: Katsushi Murakami, Tokyo, Japan

[73] Assignee: Kabushiki Kaisha Bandai, Tokyo, Japan

[ * ] Notice: The portion of the term of this patent subsequent to Jun. 26, 2001 has been disclaimed.

[21] Appl. No.: 478,452

[22] Filed: Mar. 24, 1983

[30] Foreign Application Priority Data

| | | | |
|---|---|---|---|
| Mar. 29, 1982 | [JP] | Japan | 57-50673 |
| Apr. 27, 1982 | [JP] | Japan | 57-70854 |
| Jan. 19, 1983 | [JP] | Japan | 58-6910 |
| Jan. 24, 1983 | [JP] | Japan | 58-9696 |

[51] Int. Cl.[4] ..... A63H 3/00

[52] U.S. Cl. ..... 446/73; 446/26; 446/135

[58] Field of Search ..... 63/29 R, 29 M; 224/152, 224/164, 168, 189, 170, 903; 368/10, 276, 277, 278; 446/129, 131, 132, 133, 134, 135, 136, 26, 28, 69, 73, 75

[56] References Cited

U.S. PATENT DOCUMENTS

| | | | |
|---|---|---|---|
| 1,712,171 | 5/1929 | Rochas | 63/29 |
| 2,219,277 | 10/1940 | Kaufman | 63/29 |
| 2,458,970 | 1/1949 | Wilson | 446/134 |
| 2,682,146 | 6/1954 | Wachter | 224/170 |
| 2,910,219 | 10/1959 | Bennett et al. | 248/346 |
| 3,509,734 | 5/1970 | Lederer | 63/29 M |
| 3,862,550 | 1/1975 | Sengenberger | 63/29 R |
| 4,309,879 | 1/1982 | Gretz et al. | 63/29 R |
| 4,456,384 | 6/1984 | Murakami | 446/73 |

*Primary Examiner*—Robert E. Bagwill
*Assistant Examiner*—Daniel Nolan
*Attorney, Agent, or Firm*—R. Gale Rhodes, Jr.

[57] ABSTRACT

A wrist watch type container for a toy robot or the like is provided for securely accommodating a toy robot. The wrist watch type container for a toy robot or the like comprises a casing member, strapping means, and cooperating means. The casing member comprises a hollow base portion and an edge portion extending upwardly of the peripheral margin of the hollow base portion. The strapping means is coupled to the casing member for wearing on the wrist. The cooperating means is provided in the toy robot or the like to be held in the casing member for coupling with the engaging means, whereby the toy robot or the like is suitably accommodated within the space surrounded by the edge portion. The engaging means may be a hook member, magnets, or any other suitable clamping device.

4 Claims, 10 Drawing Figures

WRIST WATCH TYPE CONTAINER FOR TOY ROBOT OR THE LIKE

BACKGROUND OF THE INVENTION (a) Field of the Invention

This invention relates to a wrist watch type container for holding or accommodating tiny toy articles such as toy robot or the like. More particularly, it pertains to a wrist watch type container which can conveniently be used by children who wishes to carry with them a toy of a relatively small dimension.

(b) Description of the Prior Art

Various small toy articles now can be manufactured in toy trade because of the development of manufacturing technique. Such small toy articles are known in the art as for example such as toy robot, toy figures, animated toys, or something like that. Generally, a toy can maintain the children's interest for a reasonable duration during playing with it. However, it is common for the children to get tired of them sooner or later. Moreover, when the children get tired of it, they often put it aside and changes to another play, which causes the toy to be lost or missed.

It has long been desired to add a plus something factor to a small toy article in order to amuse and interest the children and to maintain the children's attention longer than in the case of the conventional small toy article. It has also been desired to provide a suitable device which can hold or accommodate the tiny toy in order not to be lost or missed.

SUMMARY OF THE INVENTION

It is, therefore, a principal object of the present invention to provide a novel wrist watch type container for tiny toy articles such as toy robot or the like, which can change an image of the toy article and add a fun or amusement.

It is another object of the present invention to provide the novel wrist watch type container for toy robot or the like as above, which serves as a device for preventing a toy article from being lost or missed while the children play with something other than the tiny toy.

In keeping with these objects, and with others which will become apparent hereinafter, one feature of the present invention resides, briefly stated, in that the wrist watch type container comprises a casing member, engaging means mounted on the casing, and strapping means coupled to the casing for wearing on the wrist. The tiny article to be accommodated is provided with cooperating means which engages with the engaging means of the wrist watch type container. The casing member comprises a hollow base portion and an edge portion extending upwardly of the peripheral margin of the hollow base portion. The hollow base portion is constructed as in any suitable form for matching with an ordinary wrist watch, and comprises a top, bottom and side plates. The inner space defined by the top, bottom and side plates is a hollow within which the engaging means is mounted. The engaging means may preferably be a combination of a pair of hooks and a plate spring. Another modification of the engaging means is made of a plurality of magnets. Still another modification of the engaging means is embodied by using a clamping mechanism.

The first engaging means cooperates with a pair of openings formed in the tiny toy article to be accommodated in such a manner that the hook engages with the corresponding opening at its protruding rim. The rim extends outwardly of the margin of the opening, and thus enables for the hook to rest on the inner surface of the rim to retain engagement. The plate spring urges the tiny toy article to emerge out of the wrist watch type container when the hook is released from the engagement with the rim. The engagement can be controlled by preferably two operating levers which are made integral with the hooks and extend outwardly of the side plate of the hollow base portion. The two operating levers are mutually energized by a spring toward the outside of the base portion. The toy article can be pulled out of the wrist watch type container by merely pushing the two operating levers in a direction toward the inside of the base portion with each other.

The second engaging means is a plurality of magnets which are mounted in the hollow base portion at a predetermined location biased with a spring force. Thus, usually the magnets are located at one side within the hollow base portion, but when the toy article is required to be pulled out, an operating lever is pulled against the spring force. Since the cooperating means is also plural magnets disposed on the toy article to be accommodated, the deviation of the magnets of the container causes to face with the same polarity of the toy article magnets. Thus, the toy is pulled out due to the repulsive magnetic force.

The third engaging means is made of a clamping mechanism. This means is something similar to the first engaging means. Two pair of hooks are used for ensuring more reliable clamping with the rims formed at the peripheral edge of openings of a toy article.

In the most preferred example contemplated of the present invention which will be described hereinunder, the wrist watch type container for a toy robot or the like comprises:

a casing member comprising a hollow base portion and an edge portion extending upwardly of the peripheral margin of the hollow base portion; said hollow base portion comprising a top, bottom and side plates which define an inner space of said hollow base portion;

engaging means mounted within said inner space of said hollow base portion, said engaging means comprising a hook portion and an operating portion integrally formed with said hook portion, said hook portion extending into the space surrounded by said edge portion through an opening formed in said top plate, and said operating portion extending outwardly of the side plate;

biasing means for imparting a force on said engaging means to move it toward the outside of said inner space;

strapping means coupled to said casing member for wearing on the wrist; and cooperating means provided in said tiny toy article to be held in said casing member for coupling with said hook portion of said engaging means, whereby said tiny toy article is suitably accommodated within the space surrounded by said edge portion.

The foregoing objects and advantages of the invention as well as the structure characteristic of the invention, and modifications and improvements thereto, become more apparent to the reader from a consideration of the detailed description of the preferred embodiments of the invention which follows, taken together with the illustrations thereof presented in the accompanying figures of the drawings.

DETAILED DESCRIPTION OF THE PREFERRED EMBODIMENTS

Figure 3:
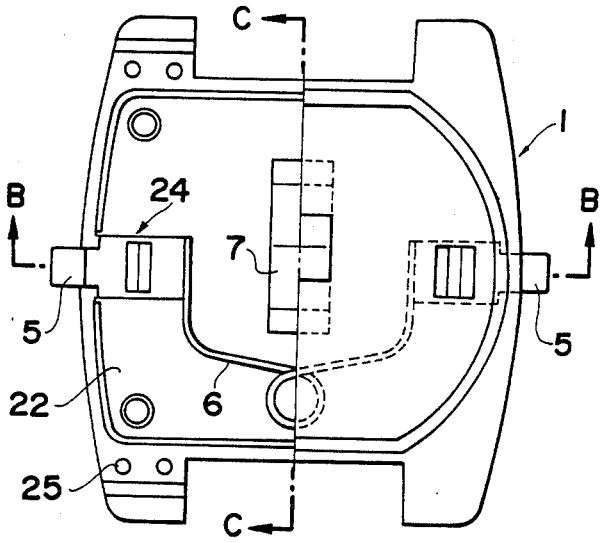
FIG. 3 is a plan view of the wrist watch type container in accordance with a first embodiment of the present invention, in which an upper plate of the wrist watch type container is partially broken away to illustrate the internal construction of the container.
Figure 4:
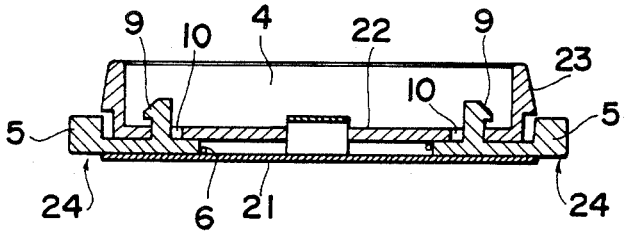
FIG. 4 is a cross-section taken along the lines B—B of FIG. 3.
Figure 5:
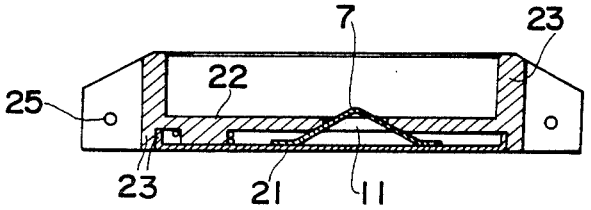
FIG. 5 is a cross-section taken along the lines C—C of FIG. 3.
Figure 6:
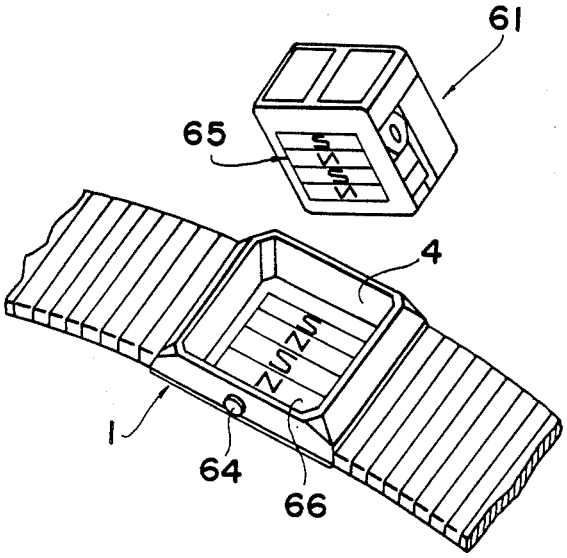
FIG. 6 is a top side perspective view of a second embodiment of the wrist watch type container in accordance with the present invention, and a bottom side perspective view of a toy robot to be accommodated within the container of the second embodiment.
Figure 7:
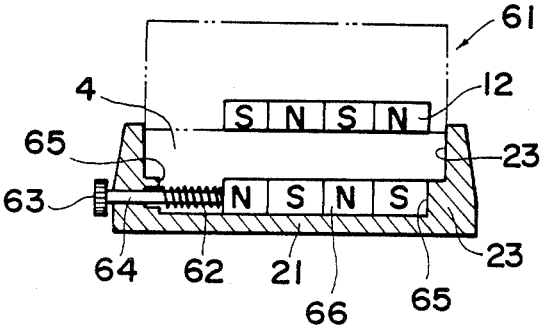
FIG. 7 is a schematic cross-section of the wrist watch type container of FIG. 6.
Figure 8:
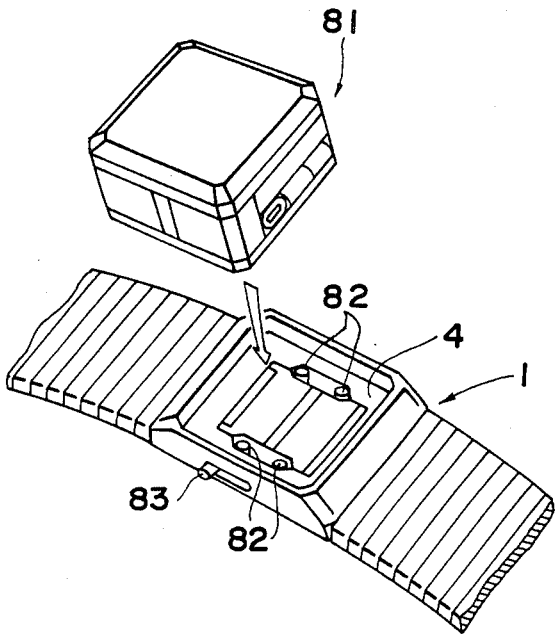
FIG. 8 is a top side perspective views of a third embodiment of the wrist watch type container in accordance with the present invention, and a toy robot to be accommodated therewithin.
Figure 9:
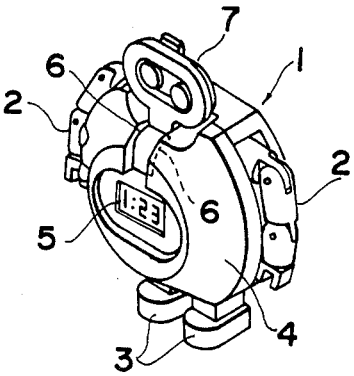
FIG. 9 is a top side perspective view of a toy robot having a timepiece on the torso thereof, which is shown here as one example of small toy articles to be held by the wrist watch type container according to the present invention.
Figure 11:
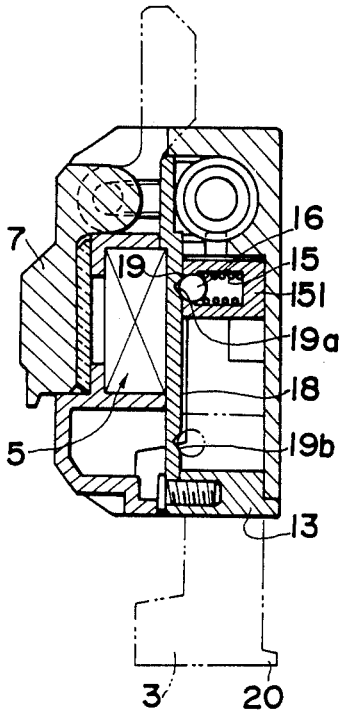
FIG. 11 is a side elevational cross-section of the toy robot shown in FIG. 9.
Figure 10:
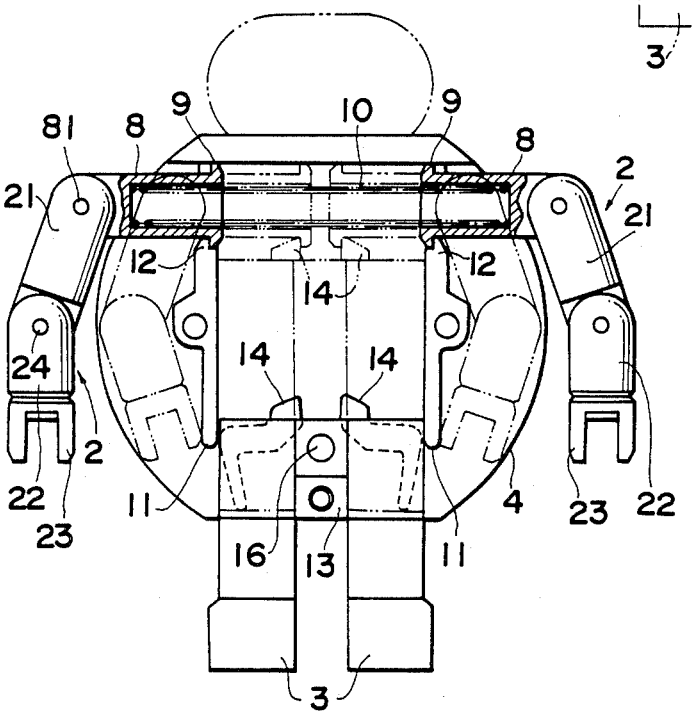
FIG. 10 is a front view of the toy robot shown in FIG. 9, in which some elements are removed away for better illustrating the internal construction of the arm and leg assemblies in their accommodated and pulled out states.

A wrist watch type container for toy robot or the like in accordance with the present invention will now be described hereinunder in detail, in conjunction with the accompanying drawings. In the figures, a first embodiment of the wrist watch type container for toy robot or the like is illustrated in FIGS. 3 to 5, a second embodiment of the container is illustrated in FIGS. 6 and 7, a third embodiment is illustrated in FIG. 8, one example of a small toy article to be received in the container is illustrated in FIGS. 9 to 11, and the manner the container is used is illustratively shown in FIGS. 1 and 2.

Figure 1:
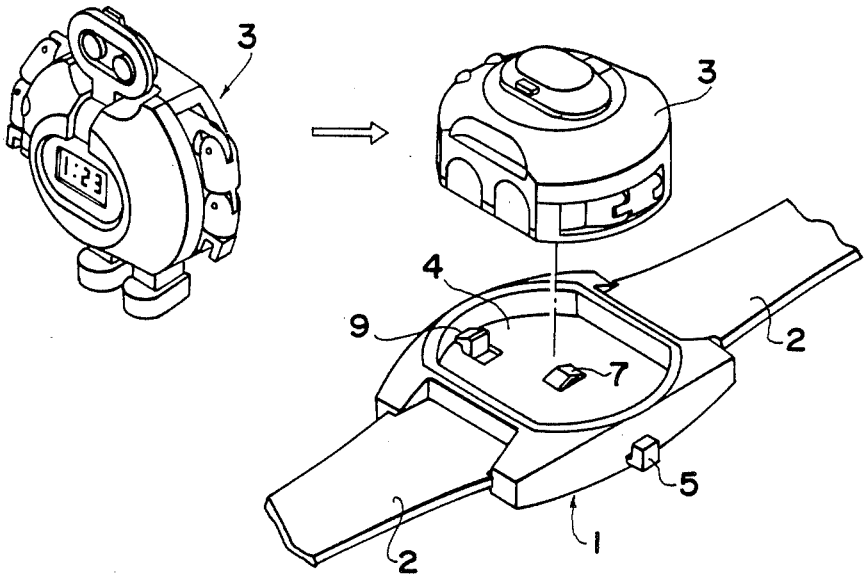
FIG. 1 is a schematic illustration representing the manner how the wrist watch type container is used for accommodating a toy robot.
Figure 2:
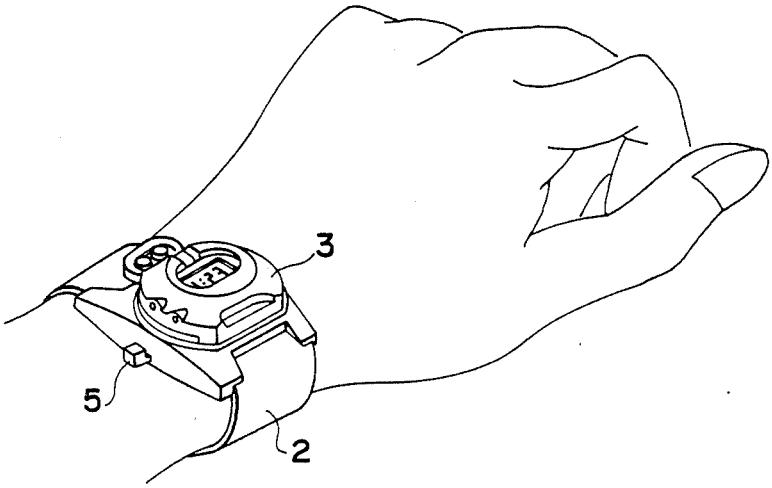
FIG. 2 is a sketch illustrating the wrist watch type container according to the present invention, in which a toy robot is accommodated and which is weared on the wrist.

Referring now first to FIGS. 1 and 2, a brief explanation of the invention is summarised. A tiny toy article, for example, a toy robot as shown in FIG. 1 is accommodated within a container 1 of a wrist watch type figure according to the present invention. The toy robot 3 shown at the left side is changed into a substantially circular shape by folding the arm and leg assemblies and a head portion. This changing operation together with the construction of the toy robot 3 is described in detail later in conjunction with FIGS. 9 to 11, as one example of tiny toy articles to be used in this invention. The wrist watch type container 1 has strapping bands 2 for wearing on the wrist as shown in FIG. 2. The coupling between the toy robot and the container 1 can be effected in various manners hereinafter described. The coupling applied to the drawing of FIG. 1 is a first embodiment of the invention shown in FIGS. 3 to 5. Reference number 4 represents a space within which the toy robot 3 is housed. Reference number 5 designates an operating handle integral with a hook portion 9, the operating handle 5 and the hook portion 9 constitute an engaging device for engaging with a cooperating device formed on the bottom surface of the toy robot. Thus, the coupling therebetween ensures a stable holding of the toy robot 3 within the space 4. Reference numeral 7 designates a plate spring which imparts a force to the bottom surface of the toy robot 3 to help its removal from the space 4 when the operating handle 5 is pushed.

A first embodiment of the wrist watch type container according to the present invention will now be explained in detail with reference to FIGS. 3 to 5. In the figures, the wrist bands 2 and hinges around which the bands moves are removed for simplification. A casing member 1 comprises a hollow base portion and an edge portion. The hollow base portion comprises a bottom plate 21, a top plate 22, and a side plate 23. The side plate 23 is made of two flanges extending upwardly of the bottom plate 21 at its peripheral margin and extending downwardly of the top plate 22. And the two flanges superpose with each other. An edge portion 23 is a wall extending upwardly of the top plate 22 at its peripheral margin, which edge portion defines the space 4 within which the toy robot 3 rests. A pair of engaging means are mounted in the space 4 of the hollow base portion. The engaging means 24 comprises a hook portion 9 formed at one end portion and an operating handle 5. The hook portion 9 and the operating portion 5 is integrally formed with each other, the hook portion and the operating portion both extending perpendicularly to the bottom plate surface. The hook portion 9 extends into the space 4 through an opening 10 formed in the top plate 22. The operating handle 5 extends over the outside of the side plate 23 for access by the person handling the container. A spring 6 is coupled between the pair of engaging means 24 for urging both means 24 to move toward the outside, or in other words to bias toward the outside of the hollow base portion. A plate spring 7 is fixed at opposite ends to the bottom plate 21, the middle part of the plate spring 21 being raised and emerging out of an opening 11 formed on the top plate 22 into the space 4 defined or surrounded by the edge portion 23. Reference number 25 indicates an aperture through which a hinge, not shown, is provided in order to couple the wrist watch band 2.

In the toy robot 3, a pair of openings are formed on the bottom surface of the toy robot 3 for cooperating with the engaging means 24. The opening is provided with a rim which extends outwardly of the margin of the opening, and thus enabling for the hook portion 9 to rest of the inner surface of the rim to retain engagement. The plate spring 7 is adapted to push the bottom surface of the toy robot 3.

In operation of the wrist watch type container thus constructed, housing operation of the toy robot 3 into the space 4 is first effected by pushing both operating handles 5 toward the inside of the inner space of the hollow base portion. Thereafter, the toy robot in an accommodated state as shown in FIG. 1 is inserted into the space 4. In this case, the openings of the bottom surface of the toy robot 3 must be correctly mated with the hook portion 9 of the engaging means 24, and the plate spring 7 is also to be pushed by the bottom surface of the robot 3. After checking the position of the hook portion 9 being in the openings and hence inside of the rim, the pushing force applied to the operating handles 5 are released. Then, due to the spring force of the spring 9, the engaging means 24 is moved outwardly from the base hollow portion to obtain a secure engagement between the rim and the hook 9. Conversely to the above, when one wishes to remove the toy robot 3 from the wrist watch type container, it suffices to simply push the operating handles 5 toward the inside of the base hollow portion. This time, the toy robot 3 is pushed by the plate spring 7 and emerges out of the container under the condition that the engagement between the hook portion 9 and the rim is released.

FIG. 6 shows a second embodiment of the wrist watch type container according to the invention, and FIG. 7 is a schematic cross-section of FIG. 6. In the figures, identical numbers have been used to those elements similar to those of the first embodiment. The difference between the first and second embodiments resides in that the engaging means and cooperating means used in the first embodiment are replaced for two sets of magnets 64 and 65. A set of magnets 66 is mounted in the inner space of the base hollow portion, and it is fixed to an operating rod 64 with a ring 63 provided at its end. A spring 62 is provided around the rod 64 between the inner surface of the side plate 65 and the junction between the rod 64 and the set of magnets 66. The other set of magnets 65 are embeded within the bottom surface of the toy robot 61.

The operation of the wrist watch type container thus constructed is as follows. The set of magnets 66 are urged toward one of the side plate 23 by the spring force. Since the other set of magnets 65 are aligned as shown in FIG. 7, each pair of the corresponding magnets attracts each other, thus retaining a secure accommodation of the toy robot 61 within the space 4. When the toy robot is required to be pulled out of the container, the rod 64 is pulled toward the outside against the force of the spring 62. Since the arrangement of the magnet pairs displace from each other, this time the magnets function to repulse the confronting magnet. As a result, the toy robot 61 can be readily removed from the container 1.

FIG. 8 shows a third embodiment of the wrist watch type container according to the invention. This embodiment is similar to the first embodiment. The engaging means 24 of the first embodiment is replaced for a combination of two pairs of clamping devices 82 and 82 which are driven by an operating handle 83 operatively connected to the two pairs of clamping devices 82 and always biased at one direction by a spring (not shown). The toy robot 81 is similarly provided with two pairs of corresponding openings as in the case of the first embodiment. The toy robot 81 is inserted within the space as shown in an arrow in the drawing and as in a similar manner described with respect to the first embodiment.

As one example of a tiny toy article, a toy robot with a timepiece is described in detail hereinafter.

Referring now to FIGS. 9 to 11, a toy robot with a timepiece is designated in its entirety by reference number 1. An arm assembly 2 is mounted in a robot body portion 4 which simulates a torso of the robot 1. A leg assembly 3 is also mounted in a robot body portion 4 at its lower position relative to the arm assembly 2. Both arm and leg assemblies 2 and 3 are constructed as they can be accommodated within and pulled out of the robot body portion as described later in more detail.

The robot body portion 4 comprises front and rear hollow body sections. In the front hollow body section, a timepiece 5 is mounted. The timepiece 5 can be of any conventional type, such as digital clock having a liquid crystal display. The timepiece 5 can be covered by a cap 7 simulating a face and head of the toy robot 1. The cap 7 is journaled for pivotal movement around a hinge 6 mounted on the front hollow body section for covering and uncovering the timepiece 5.

As is best shown in FIGS. 10 and 11, the arm assembly 2 is mounted in the rear hollow body section in such a manner as the arm assembly can be accommodated within and pulled out of the hollow of the rear body section. The arm assembly 2 comprises a pair of shoulder elements 8 and a pair of upper arms 21, a pair of lower arms 22, and a pair of hands 23. The upper arm 21 is journaled for coupling to the shoulder 8 around a pin 81 mounted at one end surface of the shoulder element 8. The pin 81 gives a large frictional contact to the bifurcated portion of the upper arm 21 so that the upper arm 21 can maintain any desired position of adjustment relative to the shoulder element 8. Similarly to the above, the lower arm 22 is journaled for coupling to the upper arm 21 around a pin 24 mounted at one end surface of the upper arm 21 opposite to the bifurcated portion thereof. The pin 24 and the bifurcated portion are coupled with a frictional restraint therebetween so that the lower arm 22 can maintain any desired position of adjustment relative to the upper arm 21. The hand 23 is formed in claw-like shape as shown in FIGS. 8 and 9, and is journaled for rotation around the axis extending to the longitudinal direction of the lower arm 22.

The shoulder element 8 is made of a cylindrical hollow member opening at one end surface and closing at the other end surface. The one end surface is provided with a rim 9 which extends perpendicularly to the longitudinal axis of the cylindrical hollow member. The other end surface is provided with the pin 81 for journaling the upper arm 21. Between the pair of the shoulder elements, a spring is inserted into the hollow of the shoulder elements 8, which spring 10 always exerts a force to move the shoulder elements 8 toward the outside of the rear hollow body section.

In the rear hollow body section, which is separated from the front hollow body section by a partition plate 18, there are provided further a pair of guide plates 11. The guide plate serves to form a guide channel for passing therethrough the leg assembly 3 to be accommodated into and pulled out of the rear hollow body section. The guide plate 11 is formed with a projection 12 which serves as a stop of the arm assembly 2, and the stop member or projection 12 engages with the rim 9 in order not to allow the arm assembly to move excessively toward outside of the rear body section. In this embodiment, a center pole 13 is mounted in the front hollow body section in order to ensure or obtain a fail safe measure for removal of the leg assembly out of the front hollow body section.

The leg assembly 3 comprises a pair of legs which may be formed as a unitary structure to move in unison or they may be formed separately and move independently of each other. In order to simplify the construction of the toy robot, in the preferred embodiment shown in FIGS. 8 to 10, a unitary structure is employed. The leg assembly 3 is made in an inverse U figure to unite a pair of legs, and is guided within the guide path defined by the guide plates 11 and the center pole 13. Each of the legs 3 has a rectangular cross-section and has a retaining device 151 formed at the upper portion thereof. An engaging device 14 of generally L figure shape of resilient synthetic resin, protrudes outwardly of the leg 3 at its top margin. This protruded portion engages with the rim 9 of the shoulder element 9 when the shoulder elements are pushed in order to be accommodated within the rear hollow section, so that the accommodated position is maintained, as shown by a two dots-dash line in FIG. 9. Conversely, when the leg assembly 3 is pulled out of the robot body portion 1, then the engagement is released between the rim 9 and the protruded portion of the projection 12, thereby allowing the arm assembly 2 to emerge out of the robot body 1 with the help of the spring force exerted by the spring 10.

In the upper hollow portion intermediate between the pair of legs 3, there is provided a retaining device 151. The retaining device 151 functions to hold the leg assembly 3 in either of the two positions where the leg assembly 3 is positioned at the accommodated and pulled out conditions. The retaining device 151 comprises a casing, spring and ball. The spring 15 is placed in the casing to push the ball 16 toward the outside of the casing. The ball 16 abuts against the surface of the partition plate 18, where notches 19*a* and 19*b* are cut across the surface. The ball 16 partially falls into the notches so that the position of the leg assembly 3 relative to the toy robot is readily determined without displacing to the large extent. The two notches 19*a* and 19*b* are formed at the positions corresponding to the leg assembly's two stable positions, that is, an accommodated position and pulled out position. Reference number 20 denotes a heel section which is used, when pulling out the leg assembly 3 out of the robot body, by catching it with a finger.

In operation, when one wishes to use the toy robot with a timepiece as a table clock, the leg assembly 3 is pulled out of the front hollow body section to the position where the ball 16 of the retaining device 151 engages with the under notch 19*b*. Since the engagement between the rim 9 and the protruded portion of the engaging device 14 is released, the arm assembly 2 is caused to move outwardly of the rear hollow body section, thereby exposing the whole upper and lower arms 21 and 22 and hands 23. In this condition, the upper and lower arms 21 and 22 and hands 23 are held in any desired position in which the arms are raised position or lowered position as shown in FIG. 8. The cap 7 is held up to show the display of the timepiece 5. Apart from the above, when one wishes to use the toy robot with a timepiece as a plaything, then one can enjoy a various figure change of the toy robot due to the provision of the construction which enables the accommodation of the arm and leg assemblies into the body of the toy robot, and the pulling out thereof from the toy robot body. Further, the arm assembly can take any desired positions due to the provision of the frictional contact between the shoulder and upper arm, and between the upper and lower arms.

What is claimed is:

1. In combination a wrist watch type container and a toy robot including a robot body, arms, legs, and a timepiece mounted on said robot body, said arms and/or legs capable of being accommodated within or pulled out of said robot body, said toy robot for being received and held within said container, said container comprising:

a casing member comprising a hollow base portion and an edge portion extending upwardly of the peripheral margin of the hollow base portion;

engaging means mounted within said hollow base portion of said casing member;

strapping means coupled to said casing member for wearing on the wrist; and cooperating means provided in said toy robot for coupling with said engaging means, whereby either the arms or legs of said toy robot are suitably accommodated within the space surrounded by said edge portion.

2. A wrist watch type container for a toy robot in accordance with claim 1, in which said engaging means comprises a hook member, and said cooperating means comprises an opening formed in said toy robot, said opening being provided with a rim extending from a margin of said opening and said rim for engagement with said hook member.

3. In combination a wrist watch type container and a toy robot including a robot body, arms, legs, and a timepiece mounted on said robot body, said arms and/or legs capable of being accommodated within or pulled out of said robot body, said toy robot for being received and held within said container, said container comprising:

a casing member comprising a hollow base portion and an edge portion extending upwardly of the peripheral margin of the hollow base portion; said hollow base portion comprising a top, bottom and said plates which define an inner space of said hollow base portion;

engaging means mounted within said inner space of said hollow base portion, said engaging means comprising a hook portion and an operating portion integrally formed with said hook portion, said hook portion extending into the space surrounded by said edge portion through an opening formed in said top plate, and said operating portion extending outwardly of the side plate;

biasing means for imparting a force on said engaging means to move it toward the outside of said inner space;

strapping means coupled to said casing member for wearing on the wrist; and cooperating means provided in said toy robot for coupling with said hook portion of said engaging means, whereby either the arms or legs of said toy robot is suitably accommodated within the space surrounded by said edge portion.

4. A wrist watch type container for a toy robot in accordance with claim 3, in which said engaging means further comprises similar engaging means arranged in said inner space symmetrically relative to the center axis of said bottom plate opposite to said engaging means, and a plate spring means mounted along said center axis on the bottom plate and emerging out of the top plate for pushing said toy robot to be held in said space surrounded by said edge portion.

* * * * *